United States Patent [19]

Hung

[11] 4,455,847

[45] Jun. 26, 1984

[54] LOCKING DEVICE OF A COMBINATION LOCK

[76] Inventor: Sheng-Hu Hung, 10-4 Fl., No. 62, Chang Chun Rd., Taipei, Taiwan

[21] Appl. No.: 388,647

[22] Filed: Jun. 15, 1982

[51] Int. Cl.[3] ..... E05B 37/04; E05B 27/06

[52] U.S. Cl. ..... 70/284; 70/358; 70/364 A; 70/421

[58] Field of Search ..... 70/284, 358, 364 A, 70/421, 419, 285

[56] References Cited

U.S. PATENT DOCUMENTS 3,670,540 6/1972 Fernandez ..... 70/421

3,938,358 2/1976 Doyle ..... 70/358

FOREIGN PATENT DOCUMENTS 817076 5/1937 France ..... 70/284

655320 7/1963 Italy ..... 70/284

*Primary Examiner*—Robert L. Wolfe

[57] ABSTRACT

An improved locking device of combination lock comprises a combination lock having toothed combination wheels, a three-way locking means formed with the shaft of the combination lock, a three-extension key and a rear locking pin normally poking into the key hole of the locking means to prevent from turning the combination lock for enhancing security.

1 Claim, 6 Drawing Figures

LOCKING DEVICE OF A COMBINATION LOCK

BACKGROUND OF THE INVENTION

The conventional combination lock may be turned to open it while listening or feeling it with sensitive fingertips. This is possible when there is a certain amount of play among the working parts of the lock; by listening intently and pulling on the spindle, the tally of the notch on each combination wheel and the projection on the spindle of the shackle can be felt.

The present inventor has found this defect of conventional combination lock and invented the present improved locking device of combination lock.

The present invention is described in details in the following specification with reference to the enclosed drawings.

SUMMARY OF THE INVENTION

The object of the present invention is to provide an improved locking device of combination lock comprising a combination lock having toothed combination wheels, a three-way locking means formed with the shaft of combination lock, a three-extension key and a rear locking pin normally poking into the key hole of the locking means so that the combination lock can not be opened by feeling and will be difficultly opened by any conventional key or instrument.

DETAILED DESCRIPTION

Figure 1:
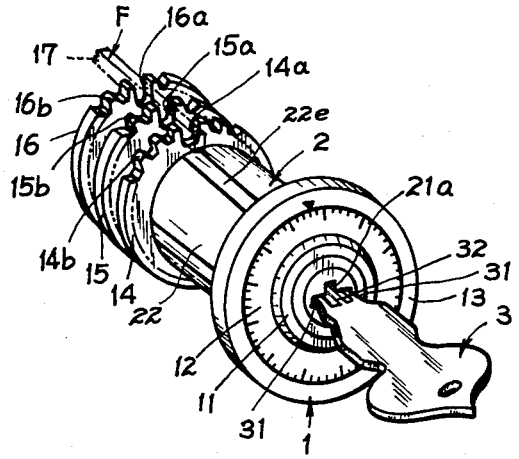
FIG. 1 is a perspective illustration of the present invention.
Figure 2:
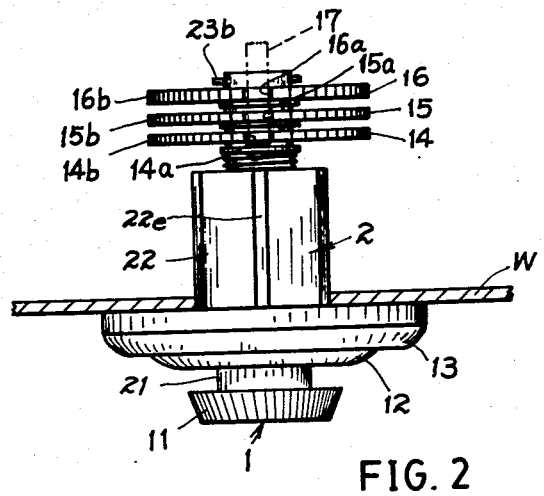
FIG. 2 is a top-view illustration of FIG. 1.

As shown in the figures, the present invention comprises a combination lock 1 having toothed combination wheel, a three-way locking means 2 formed with the shaft of combination lock, a three-extension key 3 corresponding to the key hole of locking means 2 and a rear locking pin 4 normally poking into the rear portion of the key hole of locking means 2.

Combination lock 1 is derived from conventional combination lock, which comprises a rotating knob 11, a dial 12 and a fixing disk 13. Rotating knob 11 and dial 12 are fixed to the pin tumbler cylinder 21 of locking means 2. Dial 12 is freely provided within fixing disk 13 which is fixed on a wall W of a safe or the like. Lock 1 is coaxially formed with three combination wheels 14, 15, 16, each wheel being respectively formed a slot **14*a*, 15*a*, 16*a*, thereon so as to be lined up for opening it as engaged with a latch 17 (direction F) inter-related to the safe handle. The combination wheels 14, 15, 16, are improved by the present invention as that the perimeter of each wheel is formed with continuous or intermittent teeth, 14*b*, 15*b* and 16*b*. The innermost wheel 16 is fixed on the innermost cylinder 23 of locking means 2 by a fastener 23*b* so that the combination wheel can be actuated by knob 11 and cylinder 21**.

Figure 3:
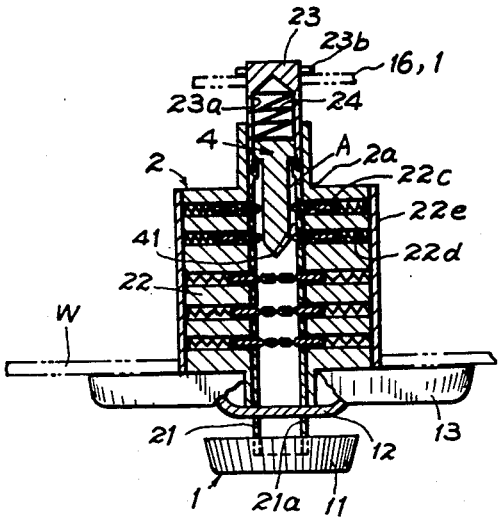
FIG. 3 is an illustration showing the locking of the present invention.
Figure 4:
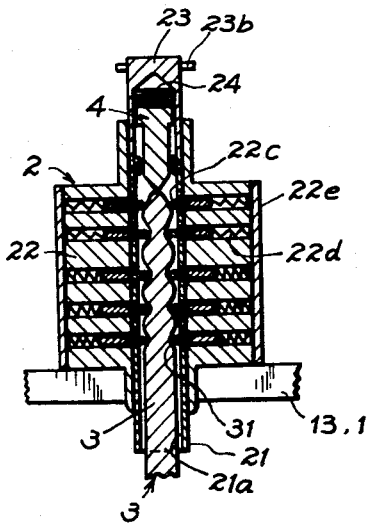
FIG. 4 is an illustration showing the opening of the present invention.
Figure 6:
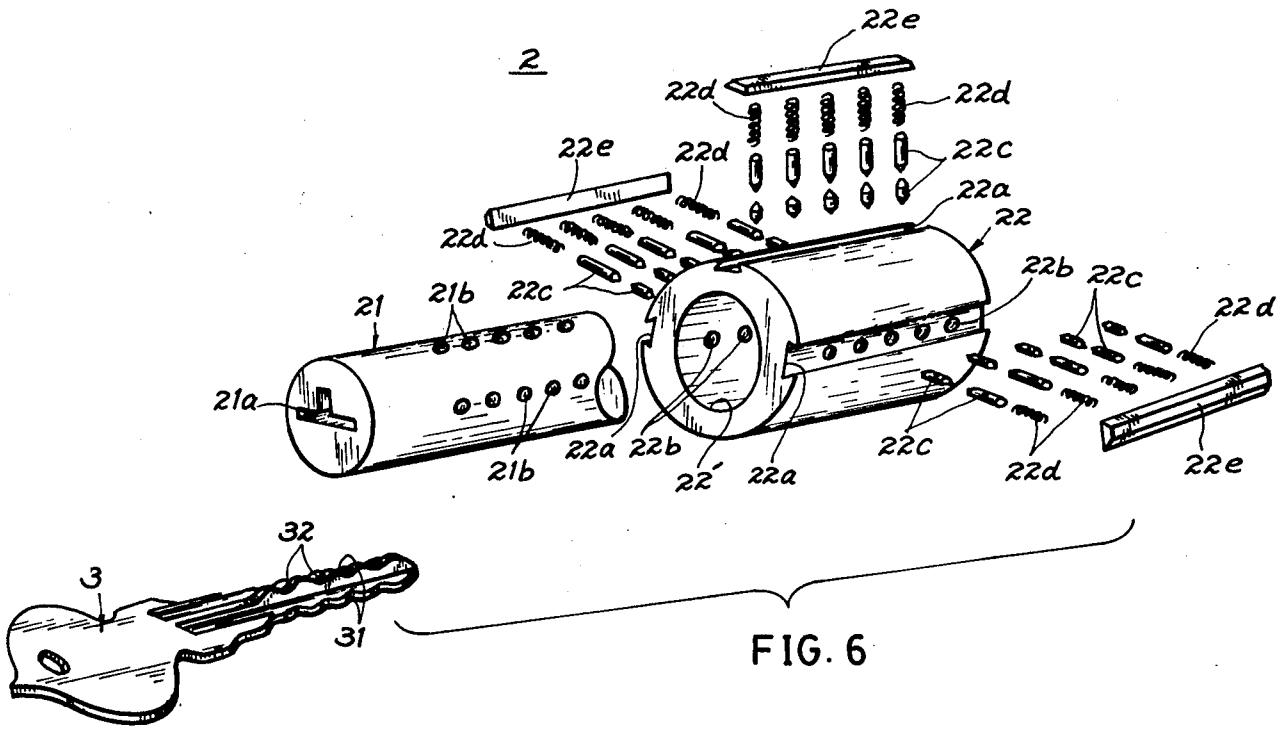
FIG. 6 is an illustration showing all parts of the three-way locking means of the present invention.

Three-way locking means 2, as shown in FIGS. 3, 4 and 6, comprises a pin tumbler cylinder 21, an outer lock body 22 and an innermost cylinder 23 backed by a spring 24 which is inserted in cylinder 23.

Pin tumbler cylinder 21 is formed with a key hole **21*a*. Three rows of pin holes 21*b* are formed through cylinder 21 so as to form a three-way pin 21*b* and key hole 21*a* as reversed T shape as FIG. 6 shown. Outer lock body 22 is centrally formed with a cylindrical hole 22' to insert cylinder 21. Plurality of pin holes 22*b* are formed through body 22 corresponding to pin holes 21*b* of cylinder 21. The perimeter of outer body 22 is formed with three longitudinal grooves 22*a* thereon, each groove 22*a* being covered by a groove cover 22*e* to restrict the pin tumblers 22*c* and springs 22*d* into pin holes 22*b*. Outer body 22** is fixed onto the wall W of a safe.

Three-extension key 3 is formed with two side serrations 31 and a central serrations 32 centrally extended from two side serrations 31 to correspond the key hole **21*a* and the wards of the spring-loaded pins 22*c*. Cylinder 21 is rearly connected with an innermost cylinder 23 which is formed a recess 23*a* to insert a spring 24 therein so as to back rear locking pin 4 poking into the rear portion of key hole 21*a*. Innermost cylinder 23 is held within a gland 2*a* of outer body 22. Gland 2*a* may be jacketed with combination wheels 14, 15, 16** thereon.

Figure 5:
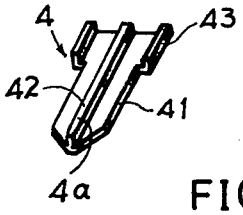
FIG. 5 is an illustration of the rear locking pin of the present invention.

Rear locking pin 4, as FIG. 5 shown, comprises two side extensions 41, a central extension 42 and a rear extension 43 so that side extensions 41 and central extension 42 can be poked into key hole **21*a*. The width of side extensions 41 is slightly smaller than the diameter of key hole 21*a* to remain an aperture A therebetween. The width of rear extension 43 is larger than the diameter of key hole 21*a* to be stopped beyond hole 21*a*. The length of side extension 41 and central extension 42 is smaller than that of key hole 21*a* so that, once backed by spring 24, pin 4 will poke into the rear portion of hole 21*a* to lock the lower halves of pin tumblers 22*c* between cylinder 21 and body 22. The front portion 4*a* of extensions 41, 42 is made acute as FIG. 5** shown.

When utilizing the present invention for locking use, key 3 is inserted into key hole **21*a* of locking means 2 for free rotation of cylinder 21 and dial 12 is then rotated to confuse the numbers. After withdrawing the key 3, the present invention is placed at the locking condition as FIG. 3 shown. When the robber tries to open the present invention, he must insert a wire or any instrument into key hole 21*a* which is very small, and try to open the lock. However, when he finds out the rear locking pin 4 of the present invention still obstructing the key hole, he must first push pin 4 backwards and then actuate all the pin tumblers 22*c* for free rotating cylinder 21. Such dual actions pushing both pin 4 and all pin tumblers 22*c* will become very difficult or impossible to open the present invention. The front portion 4*a* of rear pin 4 is formed acute. Hence, if the robber uses a slim wire to push pin 4 backwards, the front end of wire will be slipped away from pin 4. If he uses a flat-head instrument to push pin 4, there will be no other space in the key hole 21*a* to open pin tumblers 22*c*. Meanwhile, the combination wheels 14, 15, 16 of the present invention have been toothed along their perimeters so that the latch 17 will always be obstructed by the teeth 14*b*, 15*b*, 16*b* when he tries by feeling to turn the combination wheels by depressing the handle of a safe. The trial to find out the slots of the combination wheels by feeling will then become impossible without using the present key. Hence, the present invention is absolute safe superior to any conventional combination lock. When opening the present invention, key 3 is inserted into hole 21***a* to release cylinder 21 from body 22 as FIG. 4 shown for free turning said combination lock to the opening condition.

The three-way locking means 2 of the present invention may be substituted with other conventional locking means such as the form of single row of pin tumblers.

I claim:

1. An improved locking device of combination lock comprising:

a combination lock having toothed combination wheels;

a three-way locking means, forming as the shaft of the combination lock and having a pin tumbler cylinder, an outer lock body inserted in tumbler cylinder, and an innermost cylinder connected with tumbler cylinder;

a three-extension key corresponding the key hole of said locking means; and a rear locking pin normally poking into the rear portion of said key hole of said locking means to prevent from turning the combination lock for enhancing security; the improvement which comprises:

a pin tumbler cylinder and an innermost cylinder of said locking means forming as a shaft of said combination lock;

teeth formed on perimeter of each combination wheel which is coaxially formed on the shaft of said combination lock; and a rear locking pin comprises two side extensions, a central extension and a rear extension; the width of said side extensions being slightly smaller than the diameter said key hole of said locking means, the width of said rear extension being larger than the diameter of said key hole, the front portion of said side and central extensions being made acute portion, said rear locking pin, backed by a spring inserted in a recess of said innermost cylinder, poking into the rear portion of said key hole for locking use, whereby said key is inserted into key hole to release said pin tumbler cylinder from said outer lock body for free turning said combination lock for opening the lock.

* * * * *